US006810669B2

(12) United States Patent
Tanaka et al.

(10) Patent No.: US 6,810,669 B2
(45) Date of Patent: Nov. 2, 2004

(54) CLUTCH ENGAGEMENT DETECTOR AND UNIAXIAL COMBINED PLANT HAVING THE DETECTOR

(75) Inventors: Satoshi Tanaka, Hyogo (JP); Yoshiyuki Kita, Hyogo (JP); Masaaki Yamasaki, Hyogo (JP); Hiroya Komiyama, Kanagawa (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/416,500

(22) PCT Filed: Jun. 26, 2002

(86) PCT No.: PCT/JP02/06409

§ 371 (c)(1),
(2), (4) Date: May 20, 2003

(87) PCT Pub. No.: WO03/002883

PCT Pub. Date: Jan. 9, 2003

(65) Prior Publication Data

US 2004/0011040 A1 Jan. 22, 2004

(30) Foreign Application Priority Data

Jun. 28, 2001 (JP) ..... 2001-196127

(51) Int. Cl.[7] ..... F01B 21/04
(52) U.S. Cl. ..... 60/711; 60/719
(58) Field of Search ..... 60/706, 711, 716, 60/719

(56) References Cited

U.S. PATENT DOCUMENTS 3,679,033 A * 7/1972 Wagner ..... 192/48.7
4,446,955 A * 5/1984 Lech, Jr. ..... 192/206

FOREIGN PATENT DOCUMENTS

| | | |
|---|---|---|
| JP | 176386/1979 | 12/1979 |
| JP | 181927/1982 | 11/1982 |
| JP | 59-103027 | 6/1984 |
| JP | 177602/1988 | 5/1987 |
| JP | 026541/1989 | 8/1987 |
| JP | 10-184317 | 7/1998 |
| JP | 2000-356112 | 12/2000 |

* cited by examiner

*Primary Examiner*—Hoang Nguyen
(74) *Attorney, Agent, or Firm*—Oblon, Spivak, McClelland, Maier & Neustadt, P.C.

(57) ABSTRACT

This invention provides a clutch engagement detecting apparatus, which can accurately detect the state of engagement of a clutch using a helical spline engagement structure, and a single-shaft combined plant having it, and is constructed as follows: If the difference between the detected value of the rotational speed of a gas turbine and the detected value of the rotational speed of a steam turbine is not more than a detection error by the time a predetermined time elapses after load is charged into the steam turbine, it is determined that the clutch is engaged. If the detected value of the rotational speed of the steam turbine exceeds the detected value of the rotational speed of the gas turbine by a predetermined rotational speed $\alpha$ or more, or if the detected value of the rotational speed of the steam turbine falls short of the detected value of the rotational speed of the gas turbine by a predetermined rotational speed $\beta$ or more after detection of clutch engagement, it is determined that the clutch is abnormal. Alternatively, steam turbine rotation pulses are counted for each constant number of gas turbine rotation pulses, and subtraction or addition is done based on the counted value to obtain the relative rotation angle between the steam turbine and the gas turbine, thereby detecting clutch engagement.

6 Claims, 10 Drawing Sheets

FIG. 7
(a)
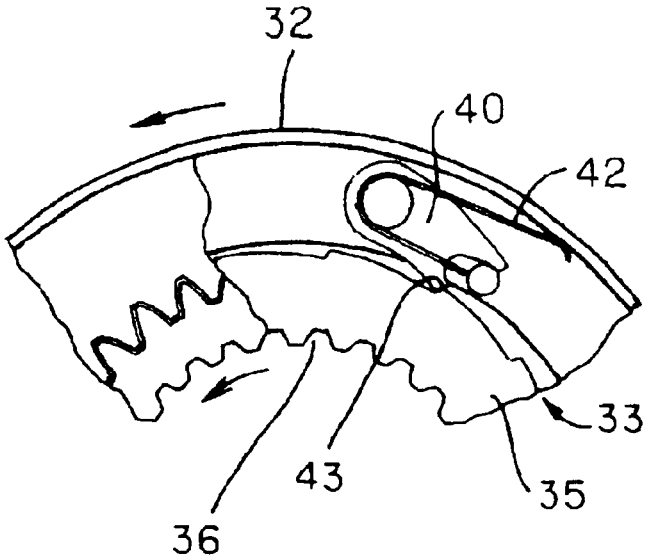
(b)
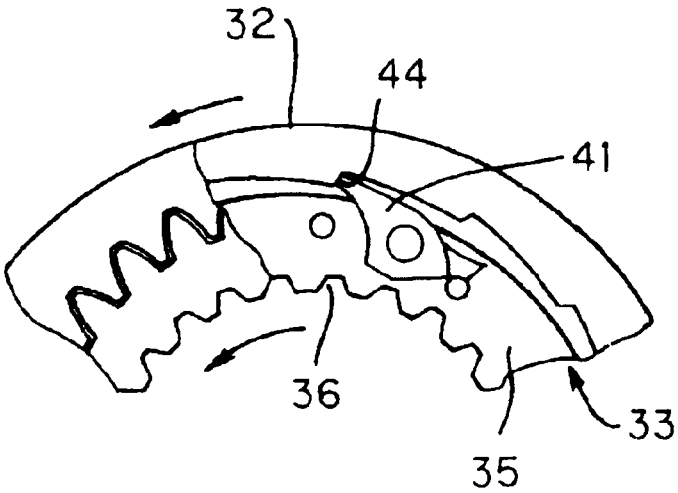

FIG. 9

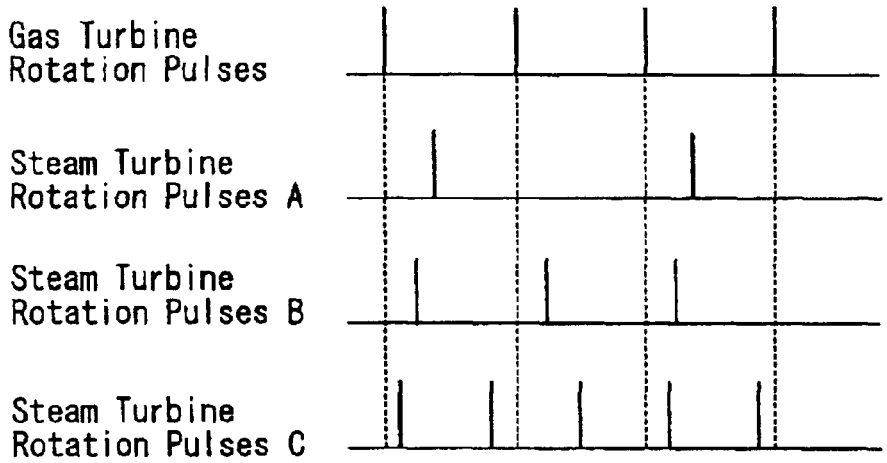

| | | | | | | | |
|---|---|---|---|---|---|---|---|
| First Counted Value A | 0 | 1 | 0 | 0 | 0 | 1 | 0 |
| First Counted Value B | 0 | 1 | 0 | 1 | 0 | 1 | 0 |
| First Counted Value C | 0 | 2 | 0 | 1 | 0 | 2 | 0 |
| Second Counted Value A | | $\gamma$ | | $\gamma-1$ | | $\gamma-1$ | |
| Second Counted Value B | | $\gamma$ | | $\gamma$ | | $\gamma$ | |
| Second Counted Value C | | $\gamma$ | | $\gamma$ | | $\gamma+1$ | |

Notes:
When the first count = 0, the second counter subtracts(-1).
When the first count = 1, the second counted value remains unchanged.
When the first count = 2, the second counter adds(+1).

CLUTCH ENGAGEMENT DETECTOR AND UNIAXIAL COMBINED PLANT HAVING THE DETECTOR

TECHNICAL FIELD

This invention relates to a clutch engagement detecting apparatus for detecting the state of engagement of a clutch, and a single-shaft combined plant having it.

BACKGROUND ART

A single-shaft combined plant, having a gas turbine and a steam turbine connected by a single shaft, is a plant with a high efficiency, involving minimal emission of hazardous substances (NOX, etc.), and flexibly accommodating diurnal changes in electric power consumption. Recently, demand has grown for a further decrease in the construction cost for this single-shaft combined plant. A conventional single-shaft combined plant involved the following factors behind the cost increase:

(1) Since the gas turbine and the steam turbine are simultaneously started, there is need for a thyristor (starter) capable of generating a huge starting torque.

(2) Since the steam turbine also rotates, together with the gas turbine, at the time of starting, cooling steam needs to be supplied to the steam turbine so that the blades of the steam turbine do not excessively rise in temperature because of windage loss. However, before the generator output by the gas turbine increases, an exhaust gas boiler, which produces steam from the exhaust gas from the gas turbine, cannot form steam that can be charged into the steam turbine. Thus, until the exhaust gas boiler forms steam which can be charged into the steam turbine, there arises the necessity for an auxiliary boiler with a very high capacity enough to supply the steam turbine with sufficient cooling steam.

To reduce the construction cost, a proposal has now been made for a single-shaft combined plant to which a clutch, as shown in FIG. 10, has been applied. In FIG. 10, a gas turbine 1 and a steam turbine 2 are connected by a single shaft 3, and a generator 4 is also connected to the shaft 3. A clutch 5 is interposed between the gas turbine 1 (generator 4) and the steam turbine 2, and this clutch 5 enables the gas turbine 1 and the steam turbine 2 to be connected and disconnected. Fuel is supplied to the gas turbine 1 via a fuel control valve 7, while steam from an exhaust gas boiler or the like is supplied to the steam turbine 6 via a steam governing valve 6.

With this single-shaft combined plant using the clutch 5, only the gas turbine 1 and the generator 4 are started first, with the gas turbine 1 and the steam turbine 2 being disconnected from each other by the clutch 5. When the gas turbine 1 reaches a rated rotational speed, the generator 4 is connected to a power system. After connection of the generator to the power system, steam, which is generated by an exhaust gas boiler (not shown) with the use of an exhaust gas from the gas turbine 1, is supplied to the steam turbine 2 at a time when the steam becomes suppliable to the steam turbine 2, thereby starting the steam turbine 2. After the steam turbine 2 reaches a rated rotational speed, the clutch 5 is engaged to convey the torque of the steam turbine 2 to the generator 4.

The clutch 5 uses a helical spline engagement structure (the same as a clutch 15 shown in FIG. 6; details will be offered later). When the rotational speed of the steam turbine 2 increases to reach the same rotational speed as the rotational speed of the gas turbine, its pawl is engaged. When the rotational speed of the steam turbine 2 further increases to exceed the rotational speed of the gas turbine 1 slightly, a sliding component slides, resulting in complete engagement of a helical spline engagement portion and a main gear portion.

According to the single-shaft combined plant using the clutch 5, only the gas turbine 1 and the generator 4 are started first, so that the capacity of the thyristor necessary for starting can be decreased (the capacity may be decreased by an amount corresponding to the weight of the steam turbine 2). Moreover, during a period for which only the gas turbine 1 and the generator 4 are operated, the steam turbine 2 rotates at a low speed, requiring no cooling steam. Thus, the capacity of the auxiliary boiler can be decreased.

To satisfactorily control the above-described single-shaft combined plant using the clutch 5, there is need for a function which can accurately determine whether the clutch 5 is in an engaged state or a disengaged state.

However, whether the clutch 5 is in an engaged state or a disengaged state cannot be determined with high reliability by use of a limit switch, because when engagement or disengagement of the clutch 5 is performed, the clutch 5 itself also rotates at a high rotational speed of 3,000 rpm (50 Hz) or 3,600 rpm (60 Hz). Currently, therefore, the engagement or disengagement of the clutch 5 is detected by detecting the axial position of the sliding component of the clutch 5 with the use of a position sensor provided near the outer periphery of the sliding component without contacting the outer periphery, although a relevant construction is not shown. This position sensor is constituted such that a high frequency current is flowed through a coil at the front end of the sensor to generate eddy currents in an object of detection (the aforementioned sliding component), and changes in the impedance of the coil in response to changes in the eddy currents are measured to detect the position of the object of detection.

With this method, however, the turbines 1 and 2 themselves rotate at high speeds, oscillate vertically or laterally, and stretch or contract. On the other hand, the location where the position sensor is attached is fixed. Hence, there are limitations to accurately determining the engagement/disengagement of the clutch 5.

Therefore, the present invention has been made in view of the above circumstances. Its problem is to provide a clutch engagement detecting apparatus, which can accurately detect the state of engagement of a clutch using a helical spline engagement structure, and a single-shaft combined plant equipped with the clutch engagement detecting apparatus.

DISCLOSURE OF THE INVENTION

A clutch engagement detecting apparatus of a first invention for solving the above problem is a clutch engagement detecting apparatus for detecting the state of engagement of a clutch using a helical spline engagement structure interposed between a first rotating machine and a second rotating machine, characterized by having a clutch engagement determination logic which determines that the clutch is engaged if the difference between the detected value of the rotational speed of the first rotating machine and the detected value of the rotational speed of the second rotating machine is not more than the detection error of rotation detecting meters for detecting the rotational speeds of the first rotating machine and the second rotating machine at a time when a predetermined time has passed during engagement of the clutch for connecting the second rotating machine to the first rotating machine.

Thus, according to the clutch engagement detecting apparatus of the first invention, the engagement of the clutch can be detected more reliably by the clutch engagement determination logic.

A clutch engagement detecting apparatus of a second invention is the clutch engagement detecting apparatus of the first invention, characterized by having a clutch abnormality determination logic which determines that the clutch is abnormal if the detected value of the rotational speed of the second rotating machine exceeds the detected value of the rotational speed of the first rotating machine by a predetermined rotational speed or more, or if the detected value of the rotational speed of the second rotating machine falls short of the detected value of the rotational speed of the first rotating machine by a predetermined rotational speed or more after the clutch engagement determination logic has determined that the clutch is engaged.

Thus, according to the clutch engagement detecting apparatus of the second invention, an abnormality of the clutch can be detected reliably by the clutch abnormality determination logic.

A clutch engagement detecting apparatus of a third invention is a clutch engagement detecting apparatus for detecting the state of engagement of a clutch using a helical spline engagement structure interposed between a first rotating machine and a second rotating machine, characterized by including pulse generation means for outputting pulse signals at constant rotation angles of the first rotating machine and the second rotating machine, and a first counter and a second counter, and characterized in that when the clutch is engaged to connect the second rotating machine to the first rotating machine, the first counter counts the number of pulses generated from the pulse generation means in response to the rotations of the second rotating machine for a constant number of pulses generated from the pulse generation means in response to the rotations of the first rotating machine, whereas the second counter does addition or subtraction according to the counted value of the first counter, and a logic is further provided for determining the state of engagement of the clutch based on the counted value of the second counter corresponding to the relative rotation angle between the first rotating machine and the second rotating machine.

Thus, according to the clutch engagement detecting apparatus of the third invention, the engaged state of the clutch can be determined reliably. Furthermore, the engaged state of the clutch can be grasped more concretely. In detail, even when the first rotating machine and the second rotating machine rotate at the same rotational speed, this does not necessarily mean that the clutch is completely engaged. According to the third invention, by contrast, it is possible to determine whether the clutch is completely engaged, or bonded halfway through engagement.

A single-shaft combined plant of a fourth invention is a single-shaft combined plant comprising a gas turbine and a steam turbine connected together by a single shaft, and a clutch using a helical spline engagement structure interposed between the gas turbine and the steam turbine, whereby the gas turbine and the steam turbine can be connected to or disconnected from each other, characterized by including the clutch engagement detecting apparatus of the first, second or third invention, and characterized in that the first rotating machine is a gas turbine and the second rotating machine is a steam turbine.

Thus, according to the single-shaft combined plant of the fourth invention, detection of engagement of the clutch essential to the single-shaft combined plant using the clutch can be performed reliably by the clutch engagement detecting apparatus. Consequently, a single-shaft combined plant can be produced at a lower cost than in the earlier technologies, by use of the clutch.

BRIEF DESCRIPTION OF THE DRAWINGS

FIGS. 7(*a*) and 7(*b*) are cross sectional views showing the structure of a pawl portion of the clutch (cross sectional views of an A portion of FIG. 6).

FIG. 9 is an explanation drawing showing concrete examples of pulse counted values in the logic.

BEST MODE FOR CARRYING OUT THE INVENTION

Embodiments of the present invention will now be described in detail with reference to the accompanying drawings.

<Embodiment 1>

Figure 5:
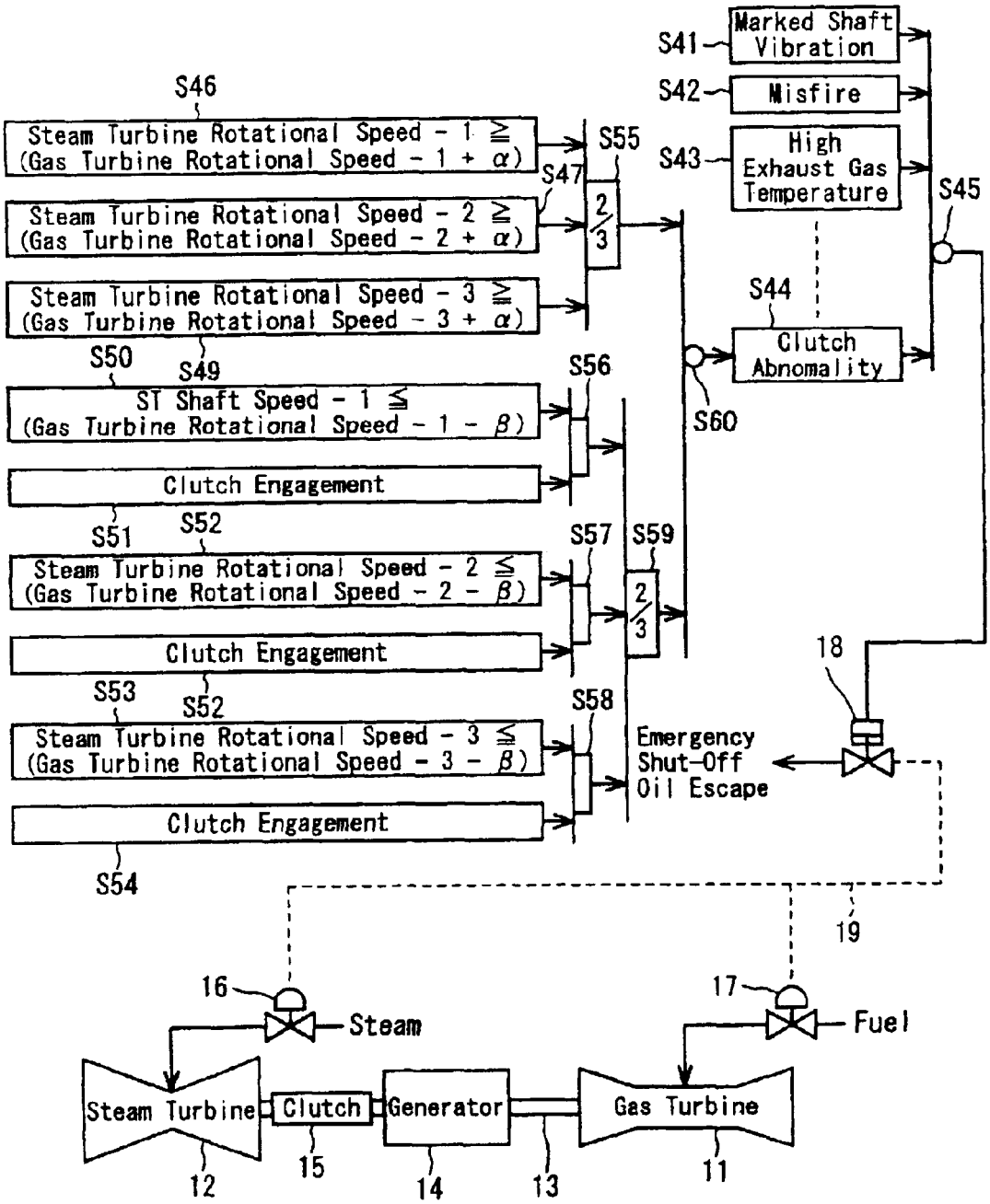
FIG. 5 is an explanation drawing of a turbine protection interlock logic using the clutch abnormality determination logic.

In a single-shaft combined plant according to the present embodiment, as shown in FIG. 5, a gas turbine 11 and a steam turbine 12 are connected by a single shaft 13, and a generator 14 is also connected to the shaft 13. A clutch 15 is interposed between the gas turbine 11 (generator 14) and the steam turbine 12, and this clutch 15 enables the gas turbine 11 and the steam turbine 12 to be connected and disconnected, thereby decreasing the capacity of a thyristor and an auxiliary boiler. Fuel is supplied to the gas turbine 11 via a fuel control valve 17, while steam from an exhaust gas boiler or the like is supplied to the steam turbine 12 via a steam governing valve 16. So-called SSS Clutch (trade name) can be applied as the clutch 15.

With this single-shaft combined plant using the clutch 15, only the gas turbine 11 and the generator 14 are started first, with the gas turbine 11 and the steam turbine 12 being disconnected from each other by the clutch 15. When the gas turbine 11 reaches a rated rotational speed, the generator 14 is connected to a power system. After connection of the generator to the power system, steam, which is generated by the exhaust gas boiler (not shown) with the use of an exhaust gas from the gas turbine 11, is supplied to the steam turbine 12 at a time when the steam becomes suppliable to the steam turbine 12, thereby starting the steam turbine 12. After the steam turbine 12 reaches a rated rotational speed, the clutch 15 is engaged to convey the torque of the steam turbine 12 to the generator 14.

The clutch 15 is of a publicly known type using a helical spline engagement structure, and has the following characteristics:

(1) The clutch is designed such that when the rotational speed of the steam turbine 12 reaches the rotational speed of the gas turbine 11, a pawl engages to engage the clutch.

(2) If the clutch is firmly engaged when engaged, and torque not less than the torque necessary for the steam turbine 12 to rotate at the present rotational speed develops in the steam turbine 12, then the clutch is not released from engagement. If the clutch is not firmly engaged, on the other hand, the burden of the generator 14 is not imposed on the steam turbine 12. Thus, the rotational speed of the steam turbine 12 surpasses the rotational speed of the gas turbine 11, becoming increasingly higher.

(3) If the propulsion torque of the steam turbine 12 is blocked (if steam supply to the steam turbine 12 is stopped) while the gas turbine 11 and the steam turbine 12 are rotating in an integrated state upon engagement of the clutch 15, the clutch 15 automatically disengages, resulting in the lowering rotational speed of the steam turbine 12.

Figure 6:
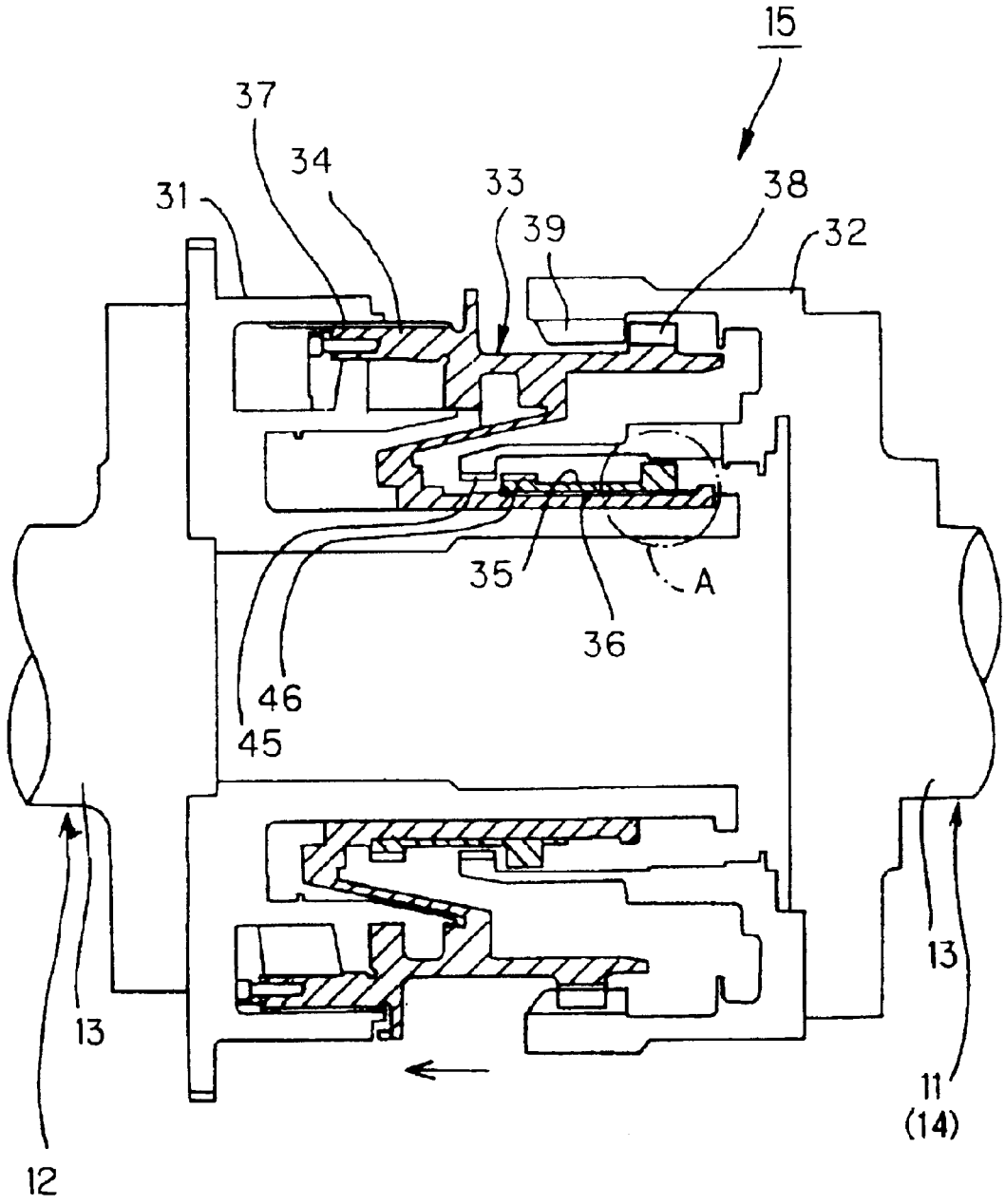
FIG. 6 is a vertical sectional view showing the structure of a clutch.

The concrete structure of the clutch 15 is as shown in FIGS. 6, 7(*a*) and 7(*b*). As indicated in FIG. 6, the clutch 15 has a drive component and a driven component (input component and output component) 31 and 32 provided on both sides in an axial direction (right-and-left direction in the drawing), and a sliding component 33 provided between the drive component 31 and the driven component 32. The sliding component 33 in FIG. 6 is hatched. The drive component 31 is connected to a rotating shaft 3 of the steam turbine 12, and rotates together with the steam turbine 12. The driven component 32 is connected to the rotating shaft 3 of the gas turbine 11 (generator 14), and rotates together with the gas turbine 11 (generator 14). The sliding component 33 rotates along with the drive component 31 before engagement of the clutch, and rotates along with the drive component/driven component 31, 32 after engagement of the clutch.

The sliding component 33 comprises a body portion 34, and a sliding portion 35 slidably engaged with the body portion 34 at a helical spline engagement portion 36. The sliding portion 35 moves axially while rotating because of the helical spline engagement portion 36. The body portion 34 is slidably engaged with the drive component 31 at a helical spline engagement portion 37, and moves axially while rotating because of the helical spline engagement portion 37. When the body portion 34 of the sliding component 33 moves leftward in the drawing, its main gear 38 engages with a main gear 39 of the driven component 32. In FIG. 6, the upper half shows the state before engagement, while the lower half shows the state of complete engagement.

As shown in FIG. 7, a primary pawl 40 urged by a spring 42 is provided in the driven component 32. In a low speed region (up to about 500 rpm), when the rotational speed of the steam turbine 12, namely, the rotational speed of the sliding component 33 rotating together with the steam turbine 12 (drive component 31), is about to surpass the rotational speed of the gas turbine 11 (driven component 32), the primary pawl 40 attached to the driven component 32 is engaged (ratcheted) with an engagement portion (ratchet portion) 43 of the outer periphery of the sliding portion 35 of the sliding component 33, whereupon the sliding portion 35 rotates together with the driven component 32. As a result, the difference in rotation angle between the drive component 31 and the driven component 32 moves the sliding portion 35 leftward in the drawing by means of the mechanism of the helical spline engagement portion 37. Then, auxiliary gears 45 and 46 engage, making the ratcheting of the primary pawl 40 reliable. When the sliding portion 35 arrives at the left end (in the drawing) of the sliding component 33, the sliding component 33 rotates along with the driven component 32. Further, the body portion 34 of the sliding component 33 also moves leftward in the drawing, so that the engaging action of the helical spline engagement portion 37 and the engaging action of the main gears 38 and 39 proceed. Finally, the helical spline engagement portion 37 completely engages, and simultaneously the main gears 38 and 39 completely engage.

In a high speed region (about 500 rpm or higher), the primary pawl 40 fails to function under a centrifugal force, but a secondary pawl 41 begins working. When the rotational speed of the steam turbine 12, namely, the rotational speed of the sliding component 33 rotating together with the steam turbine 12 (drive component 31), is about to surpass the rotational speed of the gas turbine 11 (driven component 32), the secondary pawl 41 attached to the sliding portion 35 of the sliding component 33 is engaged (ratcheted) with an engagement portion (ratchet portion) 44 of the inner periphery of the driven component 32, whereupon the sliding portion 35 rotates together with the driven component 32. As a result, the difference in rotation angle between the drive component 31 and the driven component 32 moves the sliding portion 35 leftward in the drawing by means of the mechanism of the helical spline engagement portion 37. Then, the auxiliary gears 45 and 46 mesh, making the ratcheting of the secondary pawl 41 reliable. When the sliding portion 35 arrives at the left end (in the drawing) of the sliding component 33, the sliding component 33 rotates along with the driven component 32. Further, the body portion 34 of the sliding component 33 also moves leftward in the drawing, so that the engaging action of the helical spline engagement portion 37 and the meshing action of the main gears 38 and 39 proceed. Finally, the helical spline engagement portion 37 completely engages, and simultaneously the main gears 38 and 39 completely engage.

Then, when the rotational speed of the steam turbine 12 (the rotational speed of the sliding component 33) becomes lower than the rotational speed of the gas turbine 11, the helical spline engagement portion 37 functions to move the sliding component 33 rightward in the drawing, thereby releasing the main gears 38 and 39 from engagement. Then, the helical spline engagement portion 36 functions to move the sliding portion 35 rightward in the drawing, thereby releasing the auxiliary gears 45 and 46 from engagement. At this time, the primary pawl 40 or the secondary pawl 41 is placed in a wait state, and completely disengaged.

Figure 1:
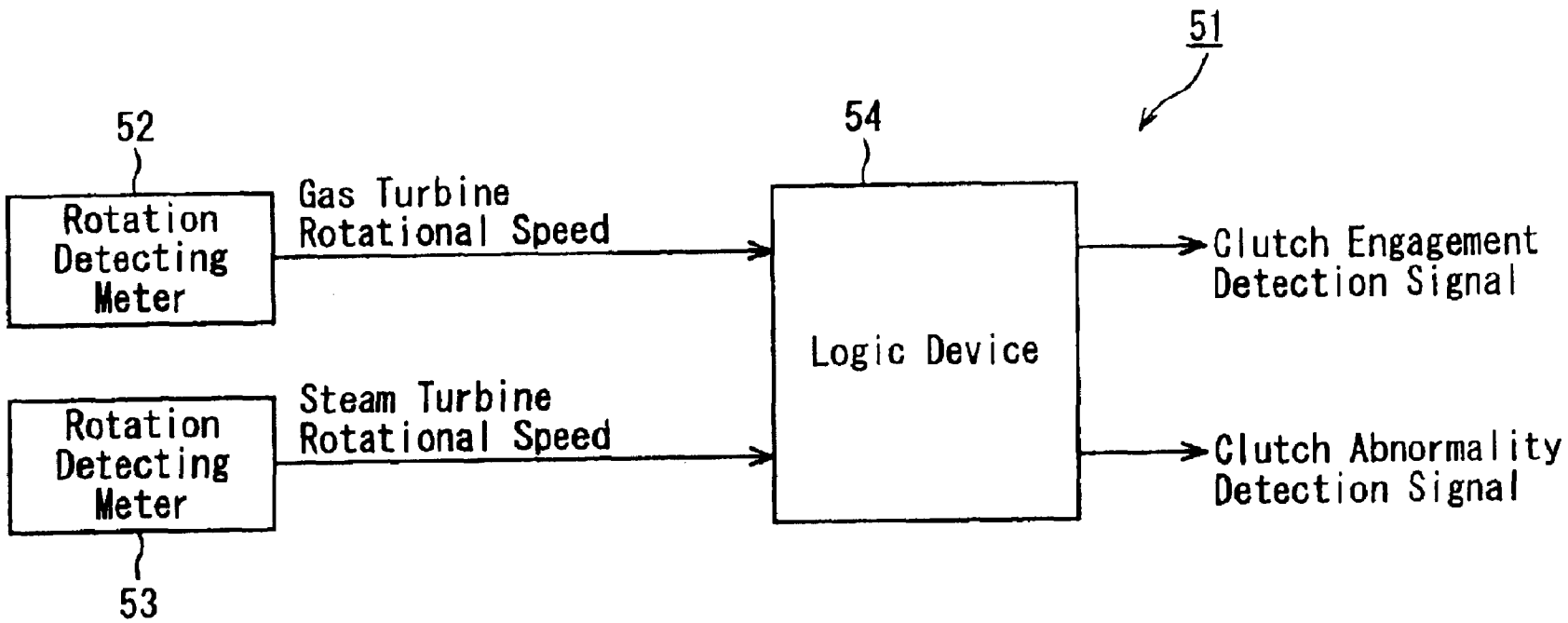
FIG. 1 is a block diagram of a clutch engagement detecting apparatus according to Embodiment 1 of the present invention.

To detect the engaged state of the clutch 15, the single-shaft combined plant of the present embodiment is equipped with a clutch engagement detecting apparatus 51 as shown in FIG. 1.

As shown in FIG. 1, the clutch engagement detecting apparatus 51 has rotation detecting meters 52, 53 and a logic device 53. The rotation detecting meters 52, 53 are installed for detecting the rotational speeds of the gas turbine 11 and the steam turbine 12 without contacting them. They are general meters which output pulse signals for each constant rotation angle of the gas turbine 11 or the steam turbine 12 (for example, 60 pulse signals for each rotation), and compute these pulse signals to obtain the rotational speeds. Suitable meters, such as eddy current electromagnetic pickups, can be used as the rotation detecting meters 52, 53. In the present Embodiment 1, the rotation detecting meter is not necessarily limited to that which outputs pulse signals, but a rotation detecting meter of other type can be employed.

Rotational speed detection signals from the rotation detecting meters 52, 53 are inputted into the logic device 54. The logic device 54 includes a clutch engagement determination logic as shown in FIG. 2, and a clutch abnormality determination logic as shown in FIG. 3.

Figure 2:
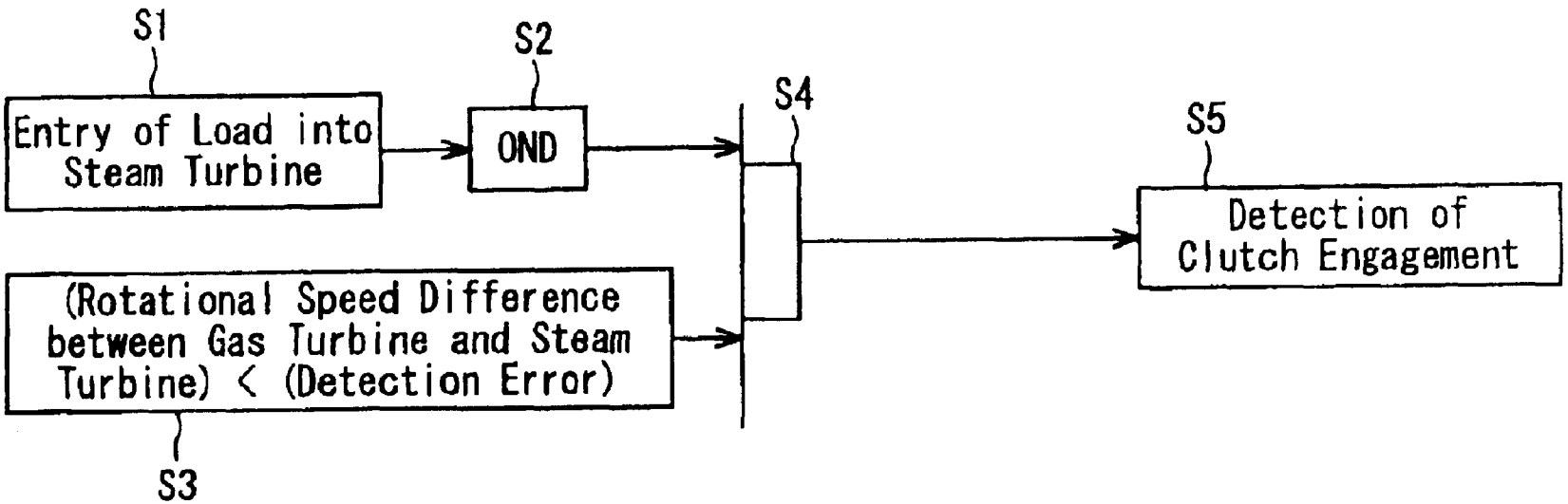
FIG. 2 is an explanation drawing of a clutch engagement determination logic provided in the clutch engagement detecting apparatus.
Figure 3:
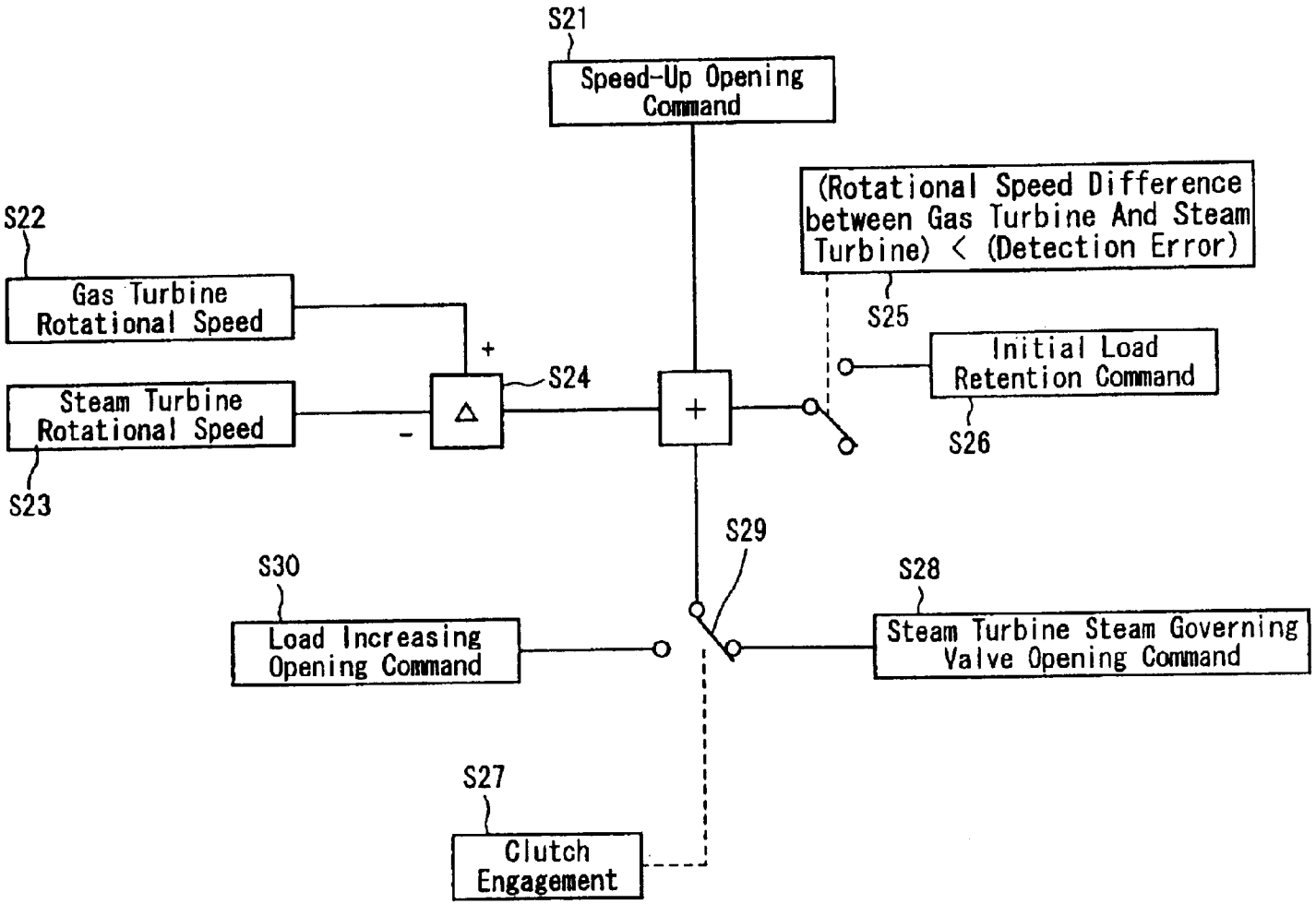
FIG. 3 is an explanation drawing of a steam turbine start logic using the clutch engagement determination logic.

As shown in FIG. 2, the clutch engagement determination logic works in the following manner: Load is entered into the steam turbine 12 (a steam turbine load entry signal is outputted) (S1). Then, a predetermined time, set by ODN (ON DELAY TIMER: one which outputs an inputted ON signal with a predetermined time delay), elapses (S2). If the difference between the detected value of the rotational speed of the gas turbine 11 by the rotation detecting meter 52 and the detected value of the rotational speed of the steam turbine 12 by the rotation detecting meter 53 is not more than the detection error of the rotation detecting meters 52, 53 (S3) by the time when the predetermined time has passed (S2) after S1, AND conditions are fulfilled (S4). Thus, it is determined that the clutch 15 has been engaged, whereupon a clutch engagement detection signal is outputted (S5).

In other words, the rotational speed of the steam turbine 2 increases, and the difference in rotational speed between the steam turbine 12 and the gas turbine 11 decreases Then, steam enough to impose load on the steam turbine 12 is entered into the steam turbine 12. Then, the steam turbine 12 is run for a while (until a predetermined time elapses). If, by this time, the difference in rotational speed between the steam turbine 12 and the gas turbine 11 is not more than the detection error of the rotation detecting meters 52, 53, it is determined that the clutch 15 is in engagement.

A steam turbine start logic using this clutch engagement determination logic will be described based on FIG. 3. In the single-shaft combined plant using the clutch 15, the logic for the start of the steam turbine needs to be constructed in consideration of the following points:

(1) It is necessary to construct the logic such that only when the clutch 15 is to be engaged, a large amount of steam is fed into the steam turbine 12 to put the clutch 15 into firm engagement. Unless the clutch 15 is firmly engaged, the clutch 15 may be disengaged later.

(2) It is necessary to construct the logic such that steam fed is gradually increased after it is determined that the load of the generator has been imposed on the steam turbine 12 upon firm engagement of the clutch 15. If a large amount of steam is fed into the steam turbine 12 in a state in which the clutch 15 is not firmly engaged and the load of the generator is not imposed on the steam turbine 12, only the rotational speed of the steam turbine 12 may be increased.

To meet the above requirements, the steam turbine start logic as shown in FIG. 3 is constructed. The contents of the steam turbine start logic are as follows:

(1) When the start conditions for the steam turbine 12 are met, the steam governing valve 16 is slightly opened, based on a speed-up opening command (S21), to flow steam into the steam turbine 12.

(2) The steam turbine 12 is increased in speed at a set speed increasing rate, with steam entering the steam turbine 12 being adjusted by the steam governing valve 16 based on the speed-up opening command (S21).

(3) The rotational speed of the gas turbine 11 measured by the rotation detecting meter 52 is compared with the rotational speed of the steam turbine 12 measured by the rotation detecting meter 53 (S22, S23, S24). During this process, the steam governing valve 16 is gradually opened to increase the rotational speed of the steam turbine 12.

(4) When the difference between the rotational speed of the gas turbine 11 and the rotational speed of the steam turbine 12 is reduced to be not more than the detection error of the rotation detecting meters 52, 53 (S25), the steam governing valve 16 is opened at a stroke to an opening corresponding to an initial load (about 10% of the full load on the steam turbine) based on an initial load retention command (S26). On this occasion, the clutch 15 is engaged. That is, when the clutch 15 is to be engaged, a large amount of steam is fed to accomplish firm engagement.

(5) A run is made for a while in the state of (4) above (initial load state) to establish a state in which the clutch 15 is firmly engaged. This is intended to avoid the clutch 15 going out of engagement later.

(6) Steam in an amount not smaller than a prescribed load is fed into the steam turbine 12, and a run is made for a while. When the clutch engagement determination logic detects "Clutch Engagement" (S27), a steam governing valve opening command (S28) is switched to a load-increasing opening command (minimum steam pressure retention) (S29, S30) to open the steam governing valve 16 gradually, thereby increasing the amount of generator output by the steam turbine 12 little by little.

Figure 4:
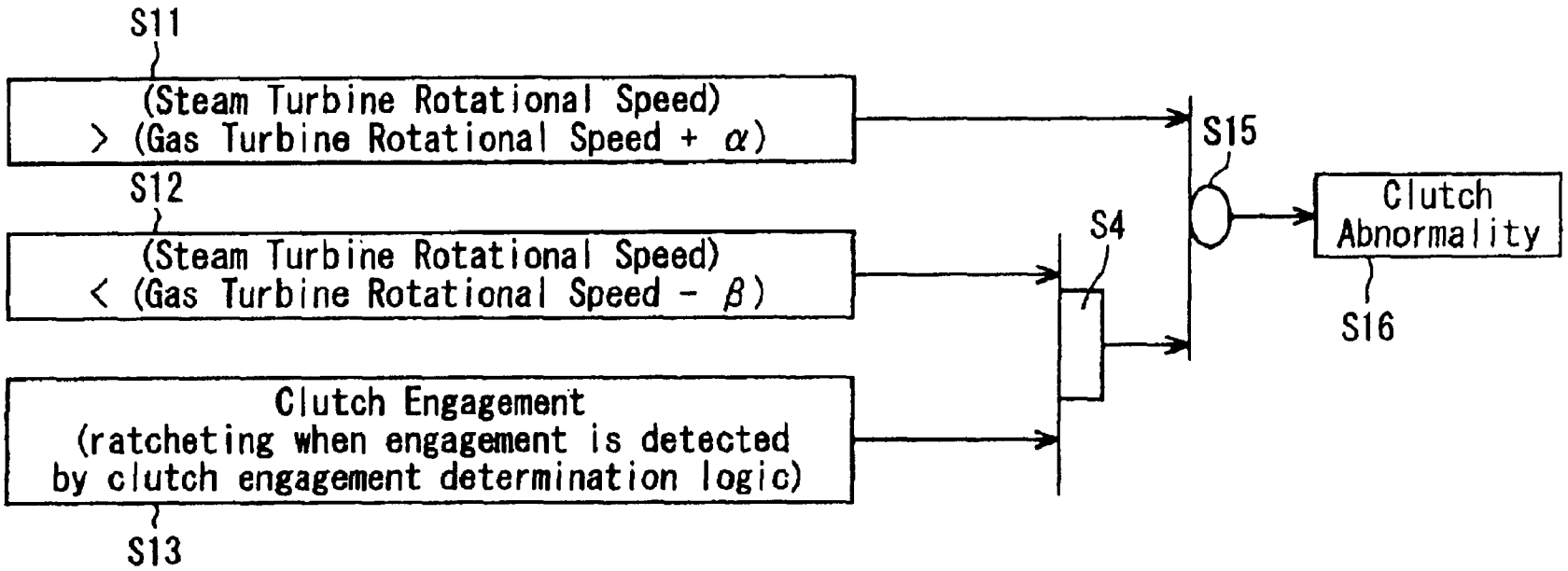
FIG. 4 is an explanation drawing of a clutch abnormality determination logic provided in the clutch engagement detecting apparatus.

With the clutch abnormality determination logic, as shown in FIG. 4, if the detected value of the rotational speed of the steam turbine 12 by the rotation detecting meter 53 surpasses the detected value of the rotational speed of the gas turbine 11 by the rotation detecting meter 52 by not less than a predetermined rotational speed $\alpha$ (S11); or (S15: OR circuit) if, after the clutch engagement determination logic has determined that the clutch 15 is engaged (S12), the detected value of the rotational speed of the steam turbine 12 by the rotation detecting meter 53 falls short of the detected value of the rotational speed of the gas turbine 11 by the rotation detecting meter 52 by not less than a predetermined rotational speed $\beta$ (S12, S13: AND circuit S14), then it is determined that the clutch 15 is abnormal. Based on this determination, a clutch abnormality signal is outputted (S16).

That is, if the rotational speed of the steam turbine 12 surpasses the rotational speed of the gas turbine 11 by not less than the predetermined rotational speed $\alpha$; or if, after it is determined that the clutch 15 is engaged, the rotational speed of the steam turbine 12 falls short of the rotational speed of the gas turbine 11 by not less than the predetermined rotational speed $\beta$, although the propulsion torque of the steam turbine 12 is not cut off (although steam supply to the steam turbine 11 is not stopped), then it is determined that the clutch 15 is abnormal (for example, the pawl 40 or 41 is broken, whereby the torque of the steam turbine 12 is not transmitted to the generator 14). In this case, both the gas turbine 11 and the steam turbine 12 are stopped for safety.

A turbine protection interlock logic using the clutch abnormality determination logic will be described based on FIG. 5.

With the single-shaft combined plant, as shown in FIG. 5, if an abnormality, such as marked shaft vibration (S41), misfire (S42) or high exhaust gas temperature (S43), occurs in the gas turbine 11 or the steam turbine 12, then a tripping electromagnetic valve 18 provided in an emergency shut-off oil line 19 is deenergized to become open, whereby an emergency shut-off oil is released from the steam governing valve 16 and the fuel control valve 17 via the emergency shut-off oil line 19. As a result, a control oil of the steam governing valve 16 and the fuel control valve 17 escapes to shut off (fully close) these valves 16 and 17. Thus, the steam turbine 12 and the gas turbine 11 can be stopped safely.

A clutch abnormality signal (S44) of the clutch abnormality determination logic is also incorporated into such a turbine protection interlock logic (relay circuit). By so doing, when the clutch abnormality signal (S44) is outputted, the tripping electromagnetic valve 18 is opened, enabling the steam turbine 12 and the gas turbine 11 to be stopped.

In FIG. 5, the clutch abnormality detection logic is multiplexed (triplexed). According to this logic, if "the condition that the detected value of the rotational speed of the steam turbine 12 surpasses the detected value of the rotational speed of the gas turbine 11 by not less than the predetermined rotational speed $\alpha$" or "the condition that after clutch engagement is detected by the clutch engagement determination logic, the detected value of the rotational speed of the steam turbine 12 falls short of the detected value of the rotational speed of the gas turbine 11 by not less than the predetermined rotational speed $\beta$" is fulfilled in two of the three conditions (S55, S59), the clutch abnormality signal (S44) is outputted (S46 to S60).

In view of the above facts, according to the present Embodiment 1, engagement of the clutch 15 can be detected more reliably by the clutch engagement determination logic shown in FIG. 2. Moreover, clutch abnormality can be detected reliably by the clutch abnormality determination logic shown in FIG. 4. The clutch engagement determination logic and the clutch abnormality determination logic are essential to the single-shaft combined plant using the clutch 15. Thus, a single-shaft combined plant can be produced at a lower cost than before with the use of the clutch 15.

<Embodiment 2>

Figure 8:
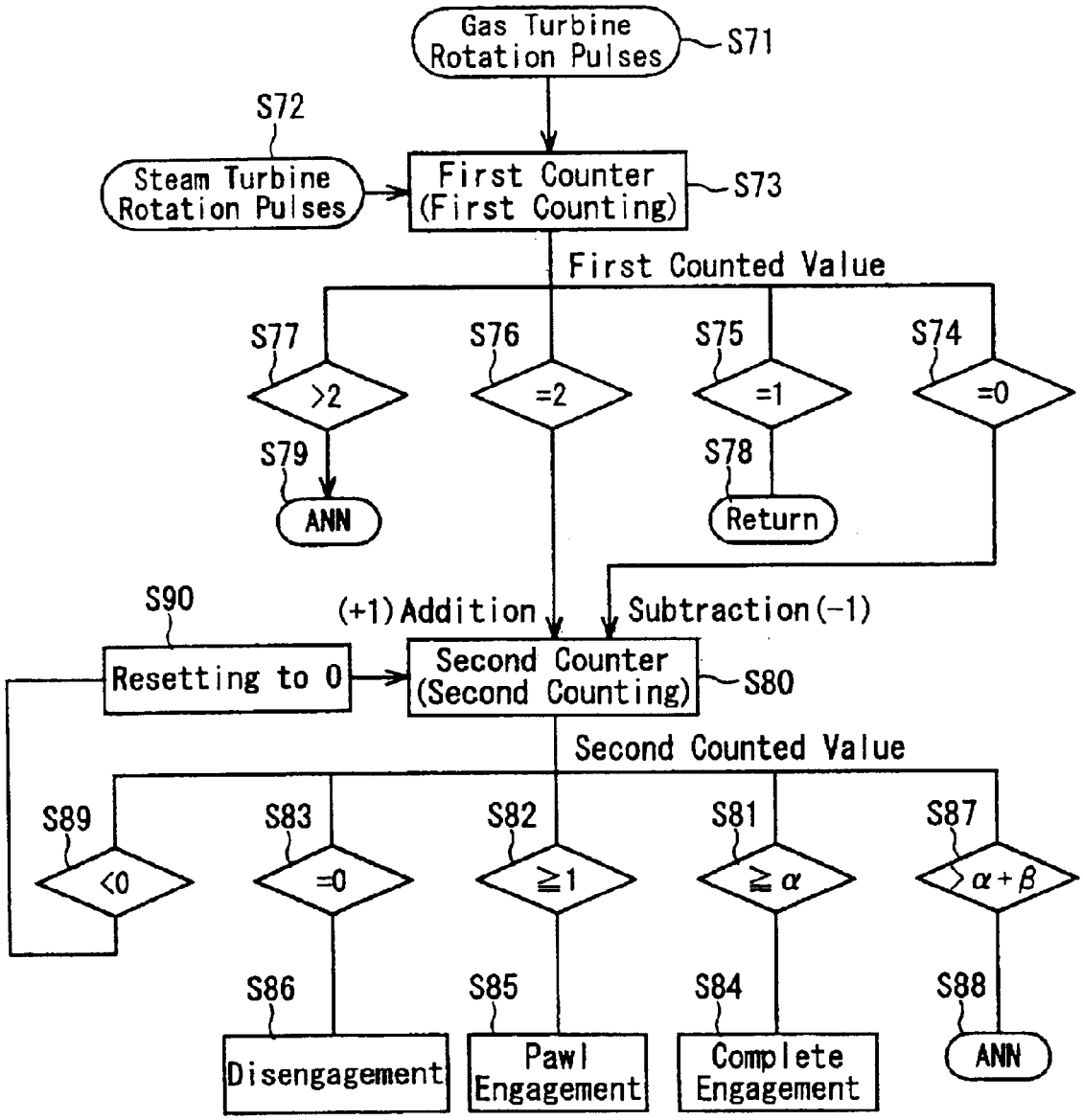
FIG. 8 is an explanation drawing of a logic of a clutch engagement detecting apparatus according to Embodiment 2 of the invention.
Figure 10:
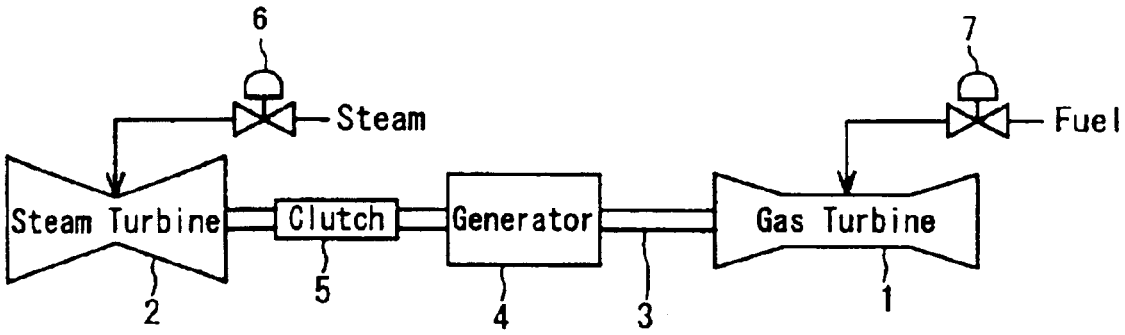
FIG. 10 is a configuration drawing of a single-shaft combined plant using a clutch.

Instead of the clutch engagement determination logic shown in FIG. 2 or the clutch abnormality determination logic shown in FIG. 4, a logic as shown in FIG. 8 may be provided in the logic device 54 of FIG. 1.

In the logic of the present Embodiment 2, the rotation detecting meters 52, 53 are used as pulse generation means. That is, rotation pulse signals outputted from the rotation detecting meters 52, 53 are utilized. The pulse generation means are not limited to these meters, but may be those which output pulse signals for each constant rotation angle of the gas turbine 11 (gas turbine rotation pulses), and which output pulse signals for each constant rotation angle of the steam turbine 12 (steam turbine rotation pulses). The gas turbine rotation pulses and the steam turbine rotation pulses are outputted for the same constant rotation angle.

As shown in FIG. 8, a first counter counts (first counting) the number of pulses outputted from the pulse generation means (rotation detecting meter 53) according to rotations of the steam turbine 12 (steam turbine rotation pulses) for each constant number of pulses outputted from the pulse generation means (rotation detecting meter 52) according to rotations of the gas turbine 11 (gas turbine rotation pulses) (S71, S71, S73). That is, the counted value is reset for the above constant number, and the steam turbine rotation pulses are counted newly from 1. The counting cycle for the steam turbine rotation pulses may involve any number of the gas turbine rotation pulses. However, the first counter is designed to count the number of the steam turbine rotation pulses outputted during a period between the time when one gas turbine rotation pulse is outputted and the time when the next gas turbine rotation pulse is outputted.

As a result, the first counted value by the first counter comes to be 0 (S74), 1 (S75), 2 (S76), or greater than 2 (S77), according to the rotational speed of the steam turbine 12.

That is, as illustrated in FIG. 9, in the case of "Steam Turbine Rotation Pulses A", with respect to "Gas Turbine Rotation Pulses", for which the steam turbine rotational speed is lower than the gas turbine rotational speed, the first counted value is 1 or 0, like the first counted value A. In the case of "Steam Turbine Rotation Pulses B", for which the steam turbine rotational speed is equal to the gas turbine rotational speed, the first counted value is continuously 1, like the first counted value B. In the case of "Steam Turbine Rotation Pulses C", for which the steam turbine rotational speed is higher than the gas turbine rotational speed, the first counted value is 2 or 1, like the first counted value C. Furthermore, if the steam turbine rotational speed is even higher than the gas turbine rotational speed, the first counted value is greater than 2, although this is not shown.

During the process from the engagement of the primary pawl 40 or secondary pawl 41 of the clutch 15 until the complete engagement of the main gears 38 and 39 via the movement of the sliding portion 35, the meshing of the auxiliary gears 45 and 46, and the movement of the sliding component 33, the steam turbine rotational speed slightly surpasses the gas turbine rotational speed (of course, the complete engagement, if accomplished, makes the steam turbine rotational speed equal to the gas turbine rotational speed). Thus, if the engaging action of the clutch 15 proceeds normally, the first counted value becomes 2, or becomes 2 or 1.

As shown in FIG. 8, if the first counted value is 1, the program goes to "Return" (S78). If the first counted value is greater than 2, "ANN (alarm)" is issued (S77). That is, if the first counted value is greater than 2, "ANN (alarm)" is issued on the assumption that the rotational speed of the steam turbine has become abnormally higher than the rotational speed of the gas turbine, because of, say, failure in the primary pawl 40 or the secondary pawl 41 (no ratcheting) (this case means that the rotational speed of the steam turbine has been detected to be not less than 150% of the rotational speed of the gas turbine; this is physically impossible and can be judged to come from failure in the logic or the measuring instrument).

If the first counted value is 0 or 2, on the other hand, the second counter performs counting (second counting) (S80). In the second counting, when the first counted value is 2, 1 is added (counted up), and when the first counted value is 0, 1 is subtracted (counted down). As illustrated in FIG. 9, the second counted value by the second counter is as follows: In the case of "the first counted value A", $\gamma$ changes into $\gamma-1$ because of a decrease like "second counted value A". For "the first counted value B", $\gamma$ remains unchanged like "the second counted value B". In the case of "the first counted value C", $\gamma$ changes into $\gamma+1$ like "the second counted value C". The second counter has the function of being automatically reset to 0, if the second counted value of the second counter is not more than 0 (S89, S90). If the second counted value of the second counter is not less than $\alpha+\beta$, it is determined that the control logic or the clutch has failed, issuing "ANN (alarm)" (S87, S88).

As shown in FIG. 8, if the second counted value by the second counter is greater than 1, it is determined that "pawl engagement" has occurred, namely, that the primary pawl 40 or the secondary pawl 41 has been engaged (ratcheted) (S82, S85). Further, if the second counted value is greater than a predetermined value $\alpha$, it is determined that "complete engagement" has taken place (S81, S84). If the second counted value is 0, on the other hand, it is determined that "disengagement" has occurred (S83, S86).

That is, as has been stated earlier, if the engaging action of the helical spline engagement portions 36, 37 in the clutch 15 proceeds normally, the rotational speed of the steam turbine slightly surpasses the rotational speed of the gas turbine, and this state continues for a certain period of time (a time until the helical spline engagement portions are completely engaged). During this period of time, the state of the first counted value becoming 2 or becoming 2 or 1 continues. Thus, the second counted value increases to the predetermined value a or more until complete engagement is accomplished (until the rotational speed of the steam turbine and the rotational speed of the gas turbine become equal, making the first counted value continuously 1). That is, the second counted value of the second counter is proportional to the relative rotation angle between the steam turbine shaft and the gas turbine shaft at the helical spline engagement portions 36, 37. Hence, by monitoring whether the second counted value has become larger than the predetermined value $\alpha$, it can be determined whether the clutch 15 has completely engaged or not.

If the helical spline engagement portions 36, 37, the auxiliary gears 45 and 46, and the main gears 38 and 39 have bonded because of seizure or the like during the engaging action, the rotational speed of the steam turbine and the rotational speed of the gas turbine become equal at this time, making the first counted value continuously 1, so that the second counted value does not reach the predetermined value $\alpha$. This means that the clutch 15 is engaged in an incomplete state. Thus, there is a risk of damage being caused to the clutch 15, or a risk of the clutch 15 going out of engagement if the load is high. If the rotational speed of the steam turbine is lower than the rotational speed of the gas turbine, the first counted value is 0 or 1, so that the second counted value is subtracted and decreased. If the second counted value is 0, therefore, it can be determined that the clutch 15 has disengaged.

The respective values set in this logic may be changed, where necessary, according to the actual clutch characteristics, the pulse counting cycle (for what number of the gas turbine rotation pulses should the steam turbine rotation pulses be counted?) and so on.

As described above, according to the present Embodiment 2, engagement of the clutch 15 or abnormality in the clutch 15 can be detected reliably, thus contributing to the realization of a single-shaft combined plant using the clutch 15. In the present Embodiment 2, moreover, the engaged state of the clutch 15 can be grasped more concretely. In detail, the fact that the gas turbine 11 and the steam turbine 12 rotate at the same rotational speed does not necessarily mean that the clutch 15 is completely engaged. According to the present Embodiment 2, by contrast, it can be determined whether the sliding portion 35 or the sliding component 33 is completely pushed in to achieve complete engagement of the helical spline engagement portions 36, 37, or these engagement portions 36, 37 are bonded halfway through engagement.

The present invention is effective for application to a single-shaft combined plant using the clutch 15, but is not necessarily limited thereto. The invention is also applicable to a case where the clutch 15 is interposed between rotating machines other than a gas turbine and a steam turbine.

Industrial Applicability

This invention relates to a clutch engagement detecting apparatus for detecting the state of engagement of a clutch, and a single-shaft combined plant having it. The invention is particularly useful for application to a single-shaft combined plant having a clutch using a helical spline engagement structure provided between a gas turbine and a steam turbine.

What is claimed is:

1. A clutch engagement detecting apparatus for detecting a state of engagement of a clutch using a helical spline engagement structure interposed between a first rotating machine and a second rotating machine, comprising:

a clutch engagement determination logic which determines that the clutch is engaged if a difference between a detected value of a rotational speed of the first rotating machine and a detected value of a rotational speed of the second rotating machine is not more than a detection error of rotation detecting meters for detecting the rotational speeds of the first rotating machine and the second rotating machine at a time when a predetermined time has passed during engagement of the clutch for connecting the second rotating machine to the first rotating machine.

2. The clutch engagement detecting apparatus of claim 1, comprising:

a clutch abnormality determination logic which determines that the clutch is abnormal if the detected value of the rotational speed of the second rotating machine exceeds the detected value of the rotational speed of the first rotating machine by a predetermined rotational speed or more, or if the detected value of the rotational speed of the second rotating machine falls short of the detected value of the rotational speed of the first rotating machine by a predetermined rotational speed or more after the clutch engagement determination logic has determined that the clutch is engaged.

3. A clutch engagement detecting apparatus for detecting a state of engagement of a clutch using a helical spline engagement structure interposed between a first rotating machine and a second rotating machine, comprising:

pulse generation means for outputting pulse signals at constant rotation angles of the first rotating machine and the second rotating machine, and a first counter and a second counter, and wherein when the clutch is engaged to connect the second rotating machine to the first rotating machine, the first counter counts the number of pulses generated from the pulse generation means in response to rotations of the second rotating machine for a constant number of pulses generated from the pulse generation means in response to rotations of the first rotating machine, whereas the second counter does addition or subtraction according to a counted value of the first counter, and a logic is further provided for determining the state of engagement of the clutch based on a counted value of the second counter corresponding to a relative rotation angle between the first rotating machine and the second rotating machine.

4. A single-shaft combined plant comprising a gas turbine and a steam turbine connected together by a single shaft, and a clutch using a helical spline engagement structure interposed between the gas turbine and the steam turbine, whereby the gas turbine and the steam turbine can be connected to or disconnected from each other, comprising the clutch engagement detecting apparatus of claim 1, and wherein the first rotating machine is a gas turbine and the second rotating machine is a steam turbine.

5. A single-shaft combined plant comprising a gas turbine and a steam turbine connected together by a single shaft, and a clutch using a helical spline engagement structure interposed between the gas turbine and the steam turbine, whereby the gas turbine and the steam turbine can be connected to or disconnected from each other, comprising the clutch engagement detecting apparatus of claim 2, and wherein the first rotating machine is a gas turbine and the second rotating machine is a steam turbine.

6. A single-shaft combined plant comprising a gas turbine and a steam turbine connected together by a single shaft, and a clutch using a helical spline engagement structure interposed between the gas turbine and the steam turbine, whereby the gas turbine and the steam turbine can be connected to or disconnected from each other, comprising the clutch engagement detecting apparatus of claim 3, and wherein the first rotating machine is a gas turbine and the second rotating machine is a steam turbine.

* * * * *